US006367991B1

(12) United States Patent
Garfinkle et al.

(10) Patent No.: US 6,367,991 B1
(45) Date of Patent: Apr. 9, 2002

(54) PROCESSING OF DEVELOPING FILM AND SENDING REPRINTS

(75) Inventors: Philip N. Garfinkle, Herndon, VA (US); Yaacov Ben Yaacov, Jerusalem (IL)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/569,943

(22) Filed: May 12, 2000

Related U.S. Application Data

(60) Provisional application No. 60/136,155, filed on May 27, 1999.

(51) Int. Cl.[7] ..... G03D 13/04

(52) U.S. Cl. ..... 396/639; 355/40; 355/77

(58) Field of Search ..... 355/40, 41, 27–29, 355/77; 396/564, 567–670, 639

(56) References Cited

U.S. PATENT DOCUMENTS

| | | | | |
|---|---|---|---|---|
| 4,417,811 | A | | 11/1983 | Hamer |
| 4,432,637 | A | | 2/1984 | Baschung |
| 4,862,200 | A | | 8/1989 | Hicks |
| 4,862,222 | A | | 8/1989 | Staude et al. |
| 4,918,484 | A | | 4/1990 | Ujie et al. |
| 4,935,809 | A | | 6/1990 | Hayashi et al. |
| 4,951,086 | A | | 8/1990 | Hicks |
| 4,974,096 | A | | 11/1990 | Wash |
| 5,023,655 | A | | 6/1991 | Hicks |
| 5,070,677 | A | | 12/1991 | Hicks |
| 5,072,254 | A | | 12/1991 | Hicks et al. |
| 5,072,256 | A | | 12/1991 | Hicks |
| 5,093,682 | A | | 3/1992 | Hicks |
| 5,097,292 | A | | 3/1992 | Hicks |
| 5,218,455 | A | | 6/1993 | Kristy |
| 5,319,401 | A | | 6/1994 | Hicks |
| 5,321,465 | A | | 6/1994 | Hicks |
| 5,477,353 | A | | 12/1995 | Yamasaki |
| 5,512,396 | A | | 4/1996 | Hicks |
| 5,666,215 | A | | 9/1997 | Fredlund et al. |
| 5,760,917 | A | * | 6/1998 | Sheridan ..... 358/442 |
| 6,017,157 | A | | 1/2000 | Garfinkle et al. |
| 6,133,985 | A | | 10/2000 | Garfinkle et al. |

* cited by examiner

*Primary Examiner*—D Rutledge
(74) *Attorney, Agent, or Firm*—Frank Pincelli

(57) ABSTRACT

The present invention is directed to a process for developing photographic film and distributing visual prints. The process includes the steps of receiving a roll of exposed photographic film from a photographer; developing the roll; scanning the negatives to produce digital images; assigning an authorization code to the digital images; uploading the digital images to at least one image server; encoding the authorization code on a physical medium; storing the digital images and the assigned authorization code on the image server; returning the developed negatives and the physical medium containing the encoded authorization code to the photographer; receiving the authorization code from the physical medium at a kiosk from a second photographer; retrieving a set of thumbnails representing the digital images represented by the authorization code from the image server; displaying the thumbnails to the second photographer; receiving an order for a visual print from the second photographer; producing the visual print; and distributing the visual print.

5 Claims, 1 Drawing Sheet

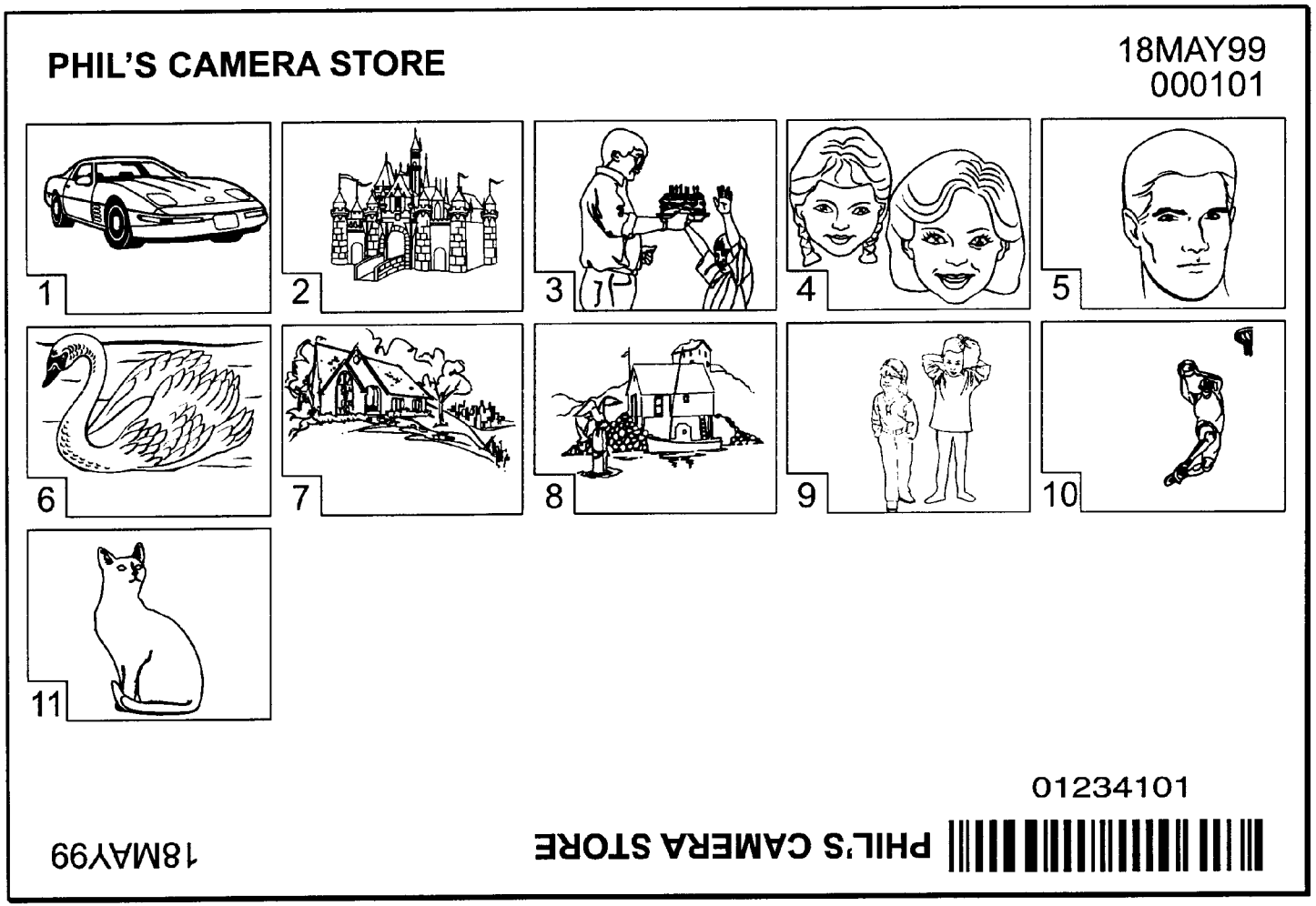
PHIL'S CAMERA STORE
18MAY99
000101
1
2
3
4
5
6
7
8
9
10
11
PHIL'S CAMERA STORE
01234101
18MAY99

PROCESSING OF DEVELOPING FILM AND SENDING REPRINTS

CROSS REFERENCE TO RELATED APPLICATIONS

This is a 111A application of Provisional Application Serial No. 60/136,155 filed May 27, 1999 entitled PROCESS OF DEVELOPING FILM AND SENDING REPRINTS; Inventors Philip N. Garfinkle and Yaacov Ben Yaacov.

BACKGROUND OF THE INVENTION

The present invention relates to a process of getting film developed and sending reprints to friends and relations. It will be appreciated that although the process of developing film is well known, it is also well known that getting reprints is an arduous and time consuming task because you have to return to the store, select the prints to produce, leave your negatives (and risk losing them), return again to pick up the reprints, then pack up and ship them to appropriate parties. This is complicated further if you would like the remote party to pick out their own pictures, which involves sending or somehow transmitting the originals to the party so that they may select the pictures they desire.

The present invention makes it easier to order reprints from remote locations. For consumers, this is a great benefit because they get control of the selection and number of pictures. In addition, in some instances, the reprints may be immediately available, saving a second trip to the store. For businesses, the present invention improves the production of reprints for cost savings. Since it is easier for consumers, it is likely to result in a higher percentage of orders as well.

The present invention includes the advantages that a consumer can order reprints without multiple trips to the store location, remote friends or relations can order reprints directly and prints and negatives do not need to be sent to relatives or left at a store location.

SUMMARY OF THE INVENTION

The present invention extends the idea of PhotoNet, a registered trademark of PictureVision, Inc., for an on-line photocenter described in U.S. patent application Ser. No. 08/773,756, now U.S. Pat. No. 6,017,157, incorporated herein by reference by placing a remote computer within a retail location. This computer can gain access to the remote images and allow any consumer in any location to place an order. The order is then immediately available to the consumer on a local print device. As a result, the remote consumer can enter a store, see the images remotely, place an order, and pick up the order, all with a single trip to the store of their choice.

DESCRIPTION OF THE DRAWING

The drawing illustrates and index print made in accordance with the present invention.

DETAILED DESCRIPTION OF THE PREFERRED EMBODIMENTS

The photographer is the person who takes a set of pictures or one who later accesses the digital images produced by this process. These pictures are exposed on a roll of photographic film. The set of pictures is referred to as a roll of film. The photographer takes an exposed roll of film to a developer. The developer develops the film in the traditional manner well known in the art to produce a developed strip of negatives.

The negatives are scanned to produce a set of digital images. The scanning preferably occurs before the negatives are cut, but could occur after as well. In a preferred embodiment, the negatives are spliced together into a reel of film, and the roll is scanned as part of a larger batch containing multiple rolls of film. Regardless of how the film is scanned, the digital images are of sufficient quality and detail for later printing. The preferred image is a 1024 by 1536 pixel 24-bit true color image for 35 mm film, or an 864 by 1536 pixel 24-bit true color image for APS (24 mm) film.

An image server is then selected where the images can be stored. An authorization code is assigned to represent the set of images in the roll. This authorization code includes an indication of which image server contains the digital images. The images and the authorization code are sent to the image server, where the digital images and the authorization code are stored for later retrieval.

The authorization code is printed or encoded and returned to the photographer with their developed negatives and any other items ordered (such as 4 by 6 pictures and the like). In one embodiment, the code is printed on a small piece of paper, which is then returned to the photographer. In a preferred embodiment, the small replicas of each image in the roll are included with the authorization code. This information may be stored on a floppy disk, encoded on some sort of flash memory card, or some other medium. In a most preferred embodiment, the images are printed in a grid on a sheet of photographic paper as an index print, with the authorization written on one image in both text and barcode as shown in the drawing.

The photographer receives their negatives and other items (such as pictures) with the material encoding the authorization code. It will be appreciated that multiple instances of the authorization code could be returned if the photographer desires or requests it.

The photographer can send or otherwise transmit the authorization code to other interested parties (referred to here as the remote photographer). A written form of the code could be sent via a fax machine, electronic mail, or other electronic medium. In the preferred embodiment, the code is sent via a postal address in the form of the produced index print as shown in FIG. 1. Alternate methods of sending the authorization code could also be envisioned. It will be further appreciated that the photofinisher could send the index print directly to a third party if the photographer provides the relevant address information when the roll is sent for development or the developed negatives are picked up.

The remote photographer receives the authorization code and takes it to a remote photofinisher location. This photofinisher may be the same one used by the original photographer, or may be another location. Similarly, the remote photographer could be the original photographer. A computer system is set up in the form of a kiosk at the remote photofinisher. This kiosk includes a computer (with monitor and data entry mechanism) and a printer. The data entry mechanism may be a keyboard and mouse, a track ball, or other mechanism. In the preferred embodiment, a touch screen monitor is used along with a card reader of a type well known in the art. The touch screen is used for interaction with the remote photographer, while the card reader is used to read the authorization code off the printed material. The card reader could be a floppy disk drive or a flash memory card reader. In the most preferred embodiment, a bar code reader is used to read the bar code from the preferred index print.

The remote photographer enters the authorization code, either manually or through the card reader mechanism. Software on the computer automatically receives the authorization code, determines the image server where the digital images are stored, and retrieves a thumbnail representation of each image suitable for display on the computer monitor. The thumbnail images are presented to the remote photographer.

A graphical user interface interacts with the remote photographer as an ordering interface so that various visual prints may be ordered. The remote photographer uses the data entry mechanism to select the desired images, the type and quantity of prints, and other required information. Note that prints as well as merchandise such as T-shirts, mugs, or puzzles could be presented for ordering.

When the order is complete, the remote photographer selects a payment method. This could be a printed invoice that is taken to the retail counter, or a special payment mechanism specially developed for the store such as a special customer code which adds the order to a customer account. In the preferred embodiment, a credit card reader is included with the kiosk where the remote photographer may slide their credit card as payment for the order. The computer in the kiosk receives the credit card and automatically authorizes the transaction at the time of sale.

When payment has been established, the order is fulfilled. Print orders may be created automatically on a printer included with the kiosk. Other orders can be sent automatically to a fulfillment location. In this later case, the order is returned to the store for later pick up by the remote photographer. Alternately, the order could be mailed directly to the remote photographer at a specified address.

Having described presently preferred embodiments of the present invention, the invention may be otherwise embodied within the scope of the appended claims.

What is claimed is:

1. A method of processing a roll of exposed photographic film containing photographic images into corresponding digital images and distributing visual prints produced from the digital images comprising the steps of:

receiving a roll of exposed photographic film containing photographic images from a photographer;

developing the roll in the traditional manner;

scanning the developed photographic film to acquire a set of digital images;

assigning an authorization code to the digital images;

encoding the authorization code on a physical medium;

storing the digital images and the assigned authorization code on at least one image server at a first location;

returning the developed photographic film and the physical medium containing the encoded authorization code to the photographer;

receiving the authorization code at a kiosk from a second photographer;

retrieving a set of thumbnails representing the digital images represented by the authorization code from at least one image server at a second location that is remote from said first location;

displaying the thumbnails to the second photographer;

receiving at least one order at the kiosk for at least one visual print from the second photographer and providing a digital image of sufficient quality to said kiosk that can be used for fulfilling said order;

producing the at least one visual print; and distributing the at least one visual print at said second location.

2. A method for ordering visual prints from a kiosk placed at a retail photofinisher at a first location with respect to a digital image stored at a remote location, comprising the steps of:

accessing said stored digital image from said kiosk;

displaying a thumbnail representation of said digital image at said kiosk;

receiving an order from a customer at said kiosk for at least one visual print with respect to said digital image;

providing a digital image of sufficient quality to said kiosk that can be used for fulfilling said order;

producing at least one visual print at said first location; and distributing the at least one visual print to said customer at said first location.

3. The method according to claim 2 wherein an index print is used for accessing said stored digital image, said index print illustrating the said digital image to be accessed and having information thereon for accessing said digital image.

4. A method according to claim 2 further comprising the steps of inputting an authorization code at the kiosk for allowing access to said stored digital image.

5. A method of processing a roll of exposed photographic film containing photographic images into corresponding digital images and distributing visual prints produced from the digital images comprising the steps of:

receiving a roll of exposed photographic film containing photographic images from a photographer;

developing the roll in the traditional manner;

scanning the developed photographic film to acquire a set of digital storing the digital images on at least one image server;

receiving a request to view said image stored on said at least one image server from a kiosk located at a remote location from said at least one image server;

retrieving a set of thumbnails representing the digital images from the at least one image server;

displaying the thumbnails at said kiosk;

receiving at least one order at the kiosk for at least one visual print;

producing the at least one visual print at said remote location; and distributing the at least one visual print at said remote location.

* * * * *

UNITED STATES PATENT AND TRADEMARK OFFICE

CERTIFICATE OF CORRECTION

PATENT NO. : 6,367,991 B1 
DATED : April 9, 2002
INVENTOR(S) : B Yaacov et al.

It is certified that error appears in the above-identified patent and that said Letters Patent is hereby corrected as shown below:

Column 4,
Line 43, delete "of digital storing the digital images on at least one image server;" and insert -- of digital images; storing the digital images on at least one image server; --

Signed and Sealed this

Second Day of July, 2002

*Attest:*

*Attesting Officer*

JAMES E. ROGAN
*Director of the United States Patent and Trademark Office*